US006629333B2

(12) United States Patent
Bolden

(10) Patent No.: US 6,629,333 B2
(45) Date of Patent: Oct. 7, 2003

(54) DEVICE AND METHOD FOR LIQUID REMOVAL FROM CARPET

(76) Inventor: Kurt E. Bolden, 22595 Voss Hiatt Rd., Cicero, IN (US) 46034

( * ) Notice: Subject to any disclaimer, the term of this patent is extended or adjusted under 35 U.S.C. 154(b) by 74 days.

(21) Appl. No.: 10/001,515

(22) Filed: Oct. 23, 2001

(65) Prior Publication Data

US 2002/0073505 A1 Jun. 20, 2002

Related U.S. Application Data

(63) Continuation-in-part of application No. PCT/US00/19891, filed on Jul. 20, 2000.

(51) Int. Cl.[7] ..... A47L 11/30; A47L 5/00
(52) U.S. Cl. ..... 15/383; 15/401
(58) Field of Search ..... 15/320–322, 353, 15/383, 401, 415.1

(56) References Cited

U.S. PATENT DOCUMENTS

| | | | | | |
|---|---|---|---|---|---|
| 1,240,799 | A | | 9/1917 | Gray | 15/320 |
| 1,268,962 | A | | 6/1918 | Gray | 15/320 |
| 1,283,499 | A | | 11/1918 | Gray | 15/383 |
| 1,527,828 | A | | 2/1925 | Barr | 15/422 |
| 1,601,774 | A | | 10/1926 | Scheffer | 15/422 |
| 3,218,876 | A | | 11/1965 | Berger | 74/202 |
| 3,683,447 | A | | 8/1972 | Stevenson | 15/352 |
| 3,936,199 | A | | 2/1976 | Zimmermann | 401/40 |
| 4,000,536 | A | | 1/1977 | Nayfa et al. | 15/50 |
| 4,069,540 | A | | 1/1978 | Zamboni | 15/320 |
| 4,145,823 | A | | 3/1979 | Lucas | 37/10 |
| 4,210,978 | A | | 7/1980 | Johnson et al. | 15/320 |
| 4,360,946 | A | * | 11/1982 | Marshall, Jr. et al. | 15/321 |
| 4,386,873 | A | | 6/1983 | Messner et al. | 15/321 |
| 4,441,229 | A | | 4/1984 | Monson | 15/322 |
| 4,577,364 | A | | 3/1986 | Demetriades | 15/383 |
| 4,595,420 | A | | 6/1986 | Williams, III et al. | 134/6 |
| 4,875,246 | A | | 10/1989 | MacGregor | 15/98 |
| 4,989,293 | A | | 2/1991 | Bashyam | 15/383 |
| 5,067,199 | A | | 11/1991 | Alazet | 15/320 |
| 5,357,650 | A | | 10/1994 | Finley | 15/401 |
| 5,485,652 | A | | 1/1996 | Holland | 15/322 |
| 5,893,216 | A | | 4/1999 | Smith et al. | 34/103 |
| 5,907,879 | A | | 6/1999 | Downey | 8/158 |
| 6,049,943 | A | * | 4/2000 | Carter | 15/340.3 |
| 6,125,499 | A | | 10/2000 | Downey | 15/321 |
| 6,152,151 | A | | 11/2000 | Bolden et al. | 134/21 |
| 6,355,112 | B1 | * | 3/2002 | Bartholmey et al. | 134/21 |
| 2003/0056317 | A1 | * | 3/2003 | Merck | 15/383 |

FOREIGN PATENT DOCUMENTS

| | | |
|---|---|---|
| GB | 1209341 | 10/1970 |

* cited by examiner

*Primary Examiner*—Terrence R. Till
(74) *Attorney, Agent, or Firm*—Woodard, Emhardt, Moriarty, McNett & Henry, LLP

(57) ABSTRACT

A deflooding device includes a suction chamber having a downward facing opening therein and a compression roller protruding downward therefrom. The roller has openings or other structure to allow water to exist beneath and inside the roller while the roller is compressing the carpet nap. A propulsion motor drive system coupled to the roller allows the unit to be self-propelled and driven at variable speeds in forward and reverse across the carpet. Operator weight standing or sitting on the device, with or without ballast or discrete additional weight applies compression of roller on carpet. Coupling from suction chamber to on-board, adjacent, or remote vacuum source is convenient.

20 Claims, 11 Drawing Sheets

DEVICE AND METHOD FOR LIQUID REMOVAL FROM CARPET

This application is a continuation-in-part of co-pending PCT patent application No. PCT/US00/19891 filed Jul. 20, 2000, published Jan. 25, 2001, No. WO 01/05290 A1 and which was based on and with original patent application Ser. No. 09/357,558 filed Jul. 20, 1999, now U.S. Pat. No. 6,152,141, issued Nov. 28, 2000. Priority is claimed based on the PCT and original patent application filing date of Jul. 20, 1999.

BACKGROUND OF THE INVENTION

The present invention relates generally to a device and method for removing liquid from carpets, such as carpets which have been flooded. The invention relates more specifically to such a device and method utilizing a compression element in combination with suction.

The water removal from carpet is an important business; for example, fire sprinkler systems or broken plumbing can flood carpeting, requiring removal of the water in an effort to restore the carpet without having to undergo the expense of replacing the carpet. It is important to remove substantially all of the standing water so as to avoid mildew and other associated problems. Current systems commercially utilized, while providing reasonable results, require a significant number of multiple passes of the vacuum apparatus to adequately deflood the carpet. Such systems include the systems shown in U.S. Pat. Nos. 5,357,650 and 4,441,229. Other systems use suction wands alone attached to high volume suction systems located in a service truck. Other systems use weighted roller systems with a separate suction receptacle placed underneath the carpet, whereby the weighted roller is used to squeegee water towards the suction water receptacle.

The industry could benefit from a system which provides greater liquid recovery from the carpet and pad, particularly such a system which removes substantially the liquid from the carpet in as few passes as possible, and ideally in a single pass. The present invention provides such a system, thereby allowing greater efficiency and lower costs as well as faster clean-up time for a given job.

SUMMARY OF THE INVENTION

The present invention provides a device and method which utilizes suction from a high volume source which may be located on-board the device or located in a remote service truck and attached to a hose or other such conduit. The source is coupled to a suction chamber on the device. A carpet compression element protrudes partially beneath the level of the bottom of a downwardly facing opening of the suction chamber. In one illustrated embodiment, a compression roller surrounded by the suction chamber has perforations or other openings therein; has one or more weights above the roller to provide pressing of the roller onto the carpet; provides a motorized propulsion system to advance the device across the carpet; and/or other features and elements as claimed below. It is noted that such features may or may not be included in a particular embodiment of the invention as summarized herein, such invention being set forth by the claims.

An object of the present invention is to provide an improved device and method for removal of liquid from carpet.

DESCRIPTION OF THE PREFERRED EMBODIMENTS

Figure 1A:
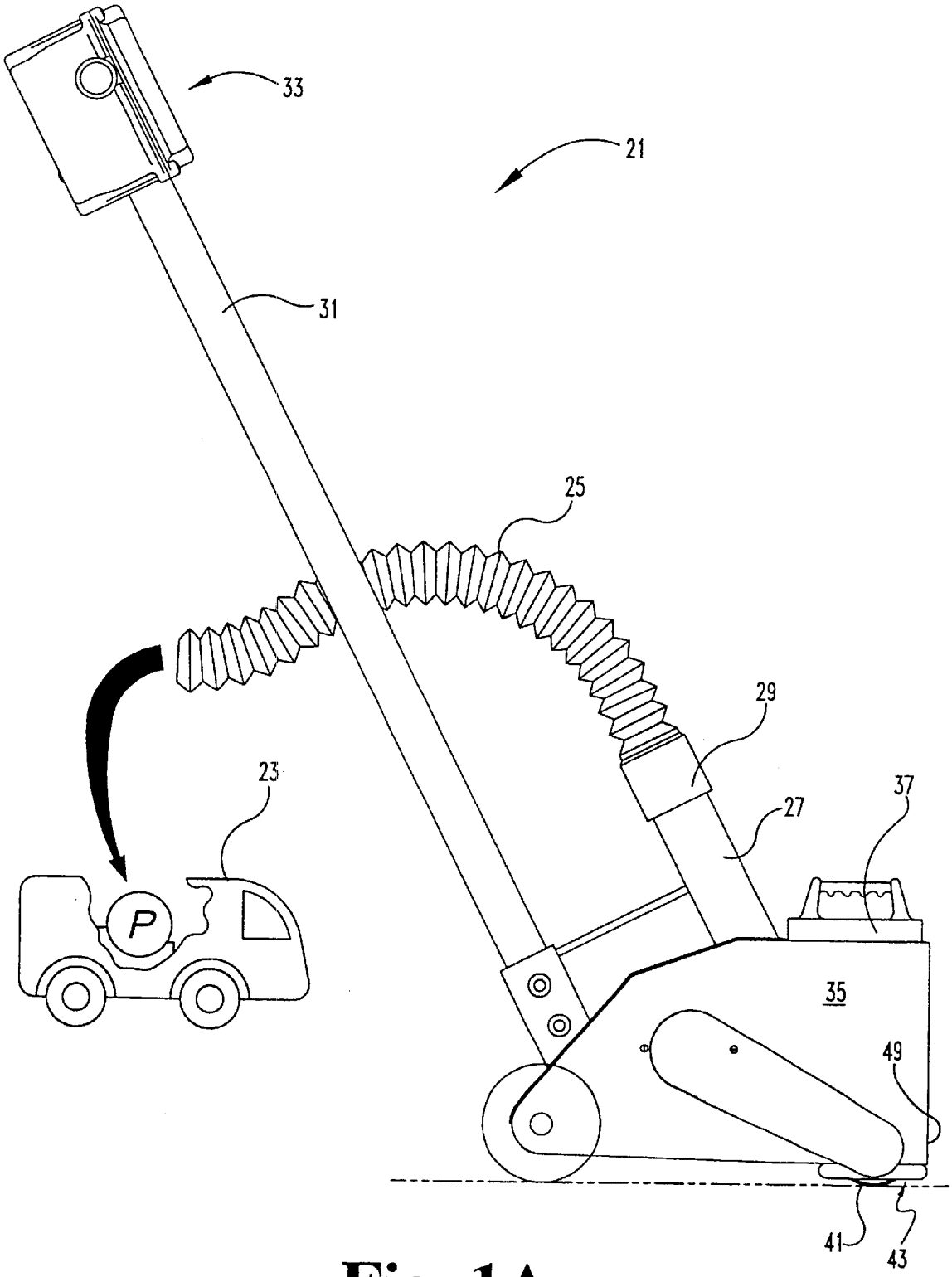
FIG. 1A is a side view of one embodiment of the present invention.
Figure 1B:
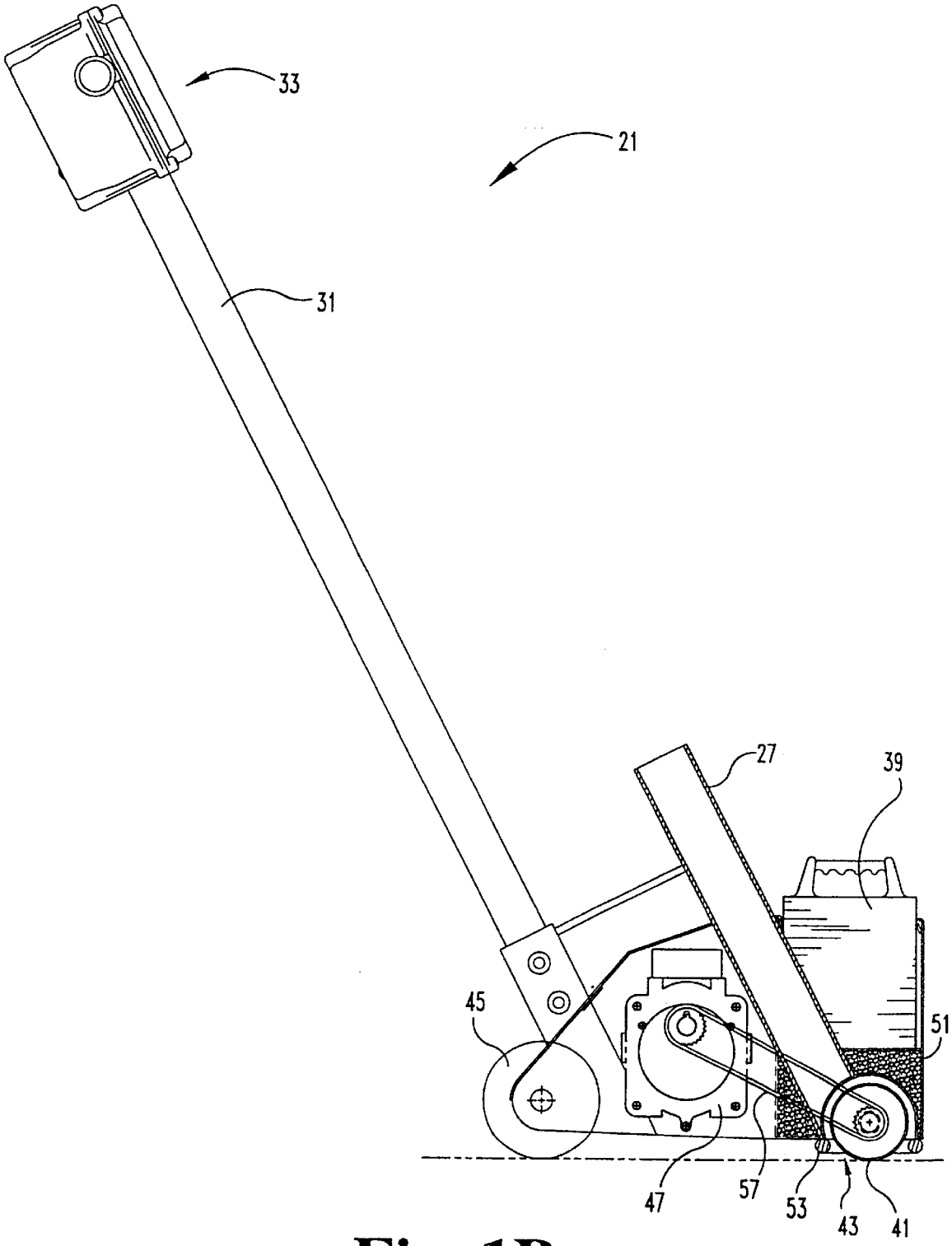
FIG. 1B is a partially cutaway side view of the device of FIG. 1A.
Figure 2A:
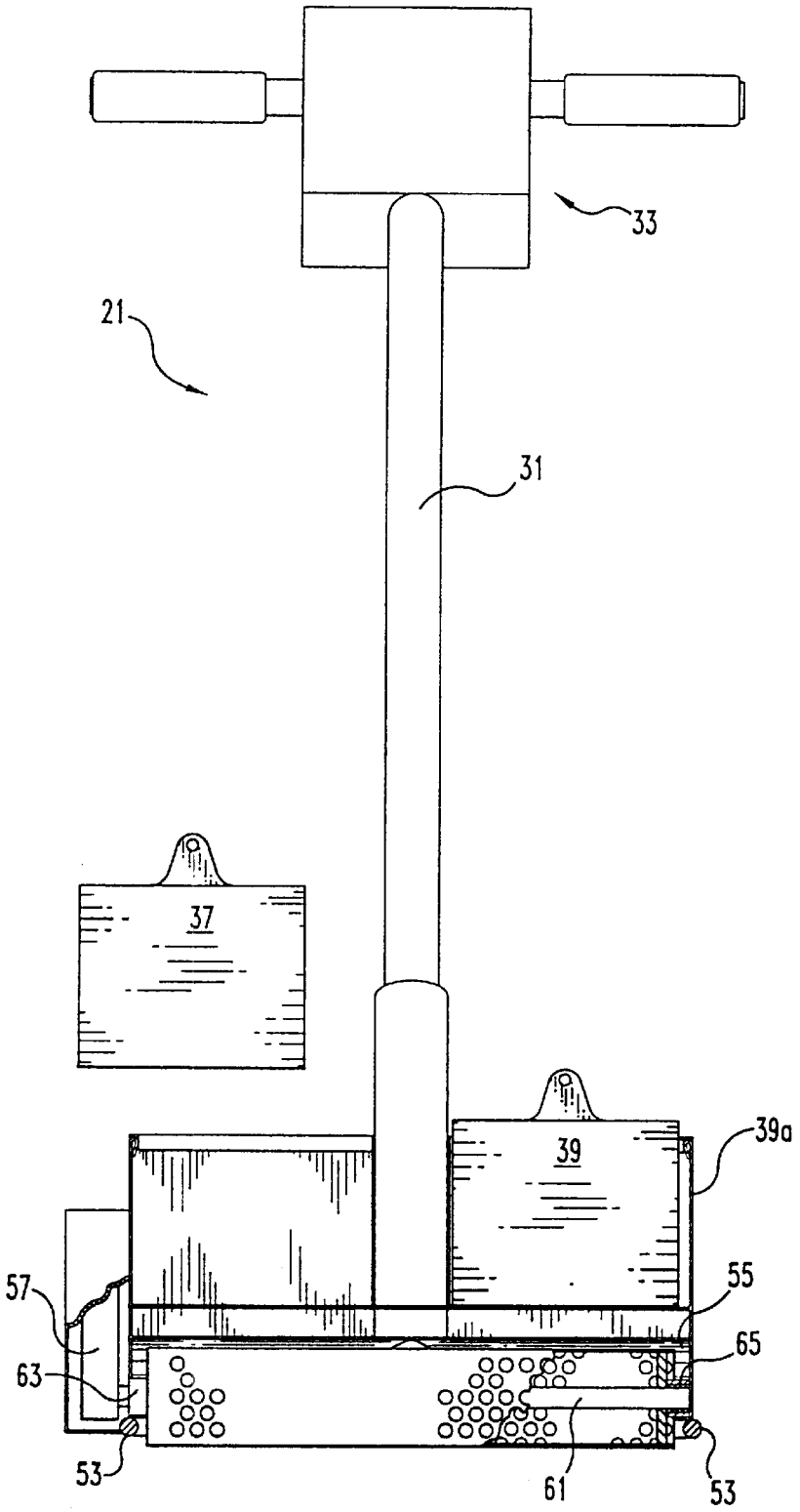
FIG. 2A is a partially cutaway front view of the device of FIG. 1A.
Figure 2B:
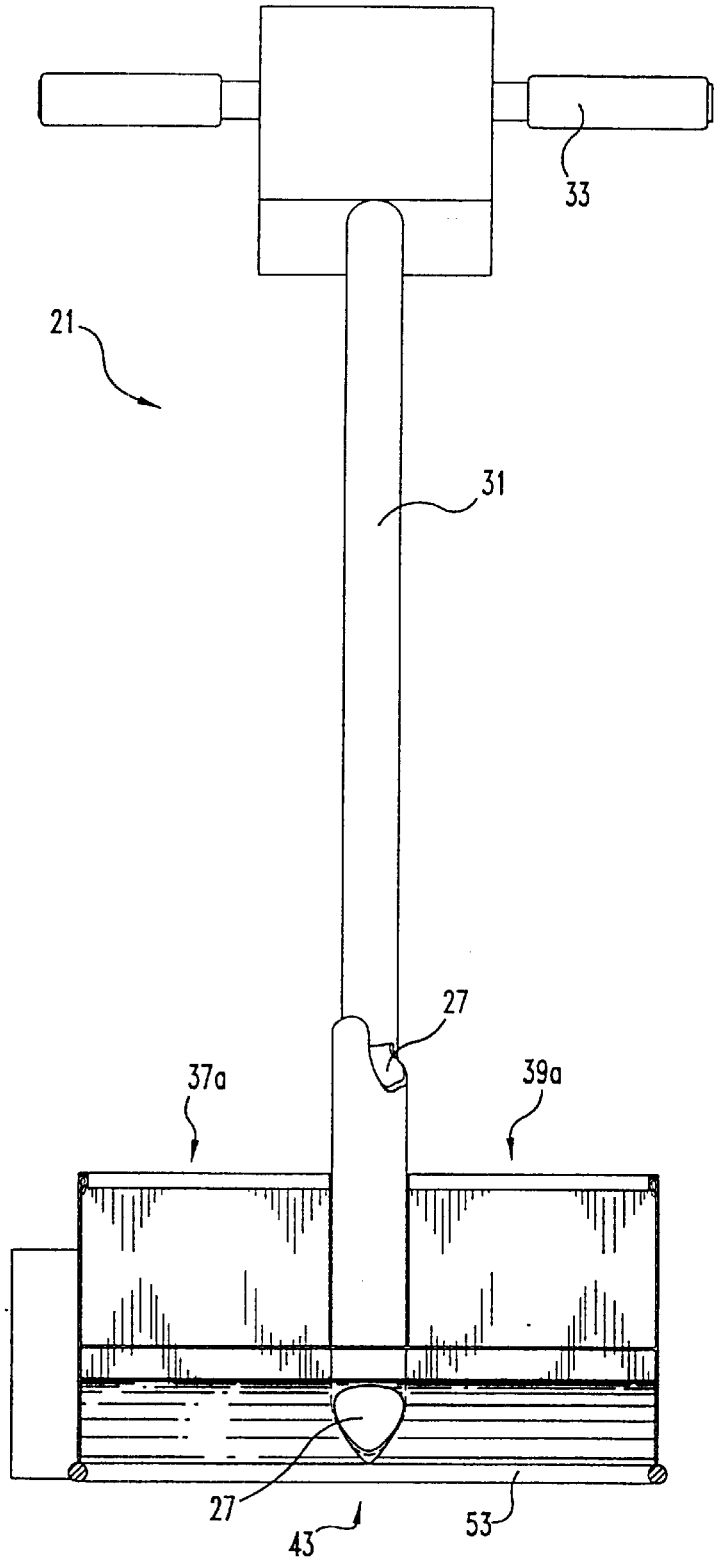
FIG. 2B is another partially cutaway front view of the device of FIG. 1A with the roller and removable weights removed.
Figure 4:
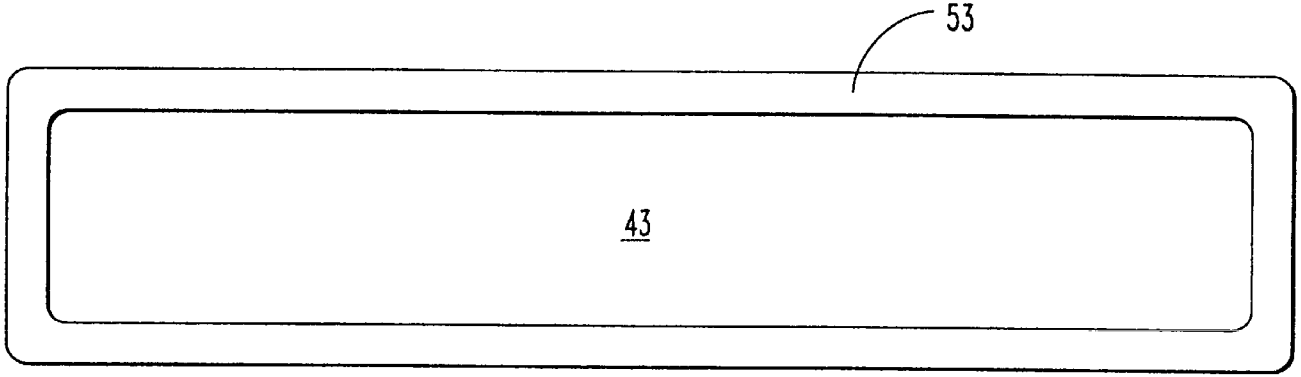
FIG. 4 is a bottom view of the frame taken in isolation.

For the purposes of promoting an understanding of the principles of the invention, reference will now be made to the embodiments illustrated in the drawings and specific language will be used to describe the same. It will nevertheless be understood that no limitation of the scope of the invention is thereby intended, and alterations and modifications in the illustrated device and method, and further applications of the principles of the invention as illustrated therein are herein contemplated as would normally occur to one skilled in the art to which the invention relates.

Referring to the drawing figures, preferred embodiments of the claimed invention are illustrated. Referring to FIGS. 1–5 in particular, the deflooding device 21 preferably is coupled to a suction pump truck 23 having a pump P therein. Such coupling is by a flexible conduit 25 (shown in FIG. 1A schematically coupled to pump P) coupled to a discharge end of conduit 27 by coupling 29. Conduit 25 as illustrated preferably is separate from and not a part of the handle arm 31. Conduit 27 may be very short, even a stub or bayonet coupling to the suction chamber. The pump P preferably is a high powered truck-mounted suction system delivering approximately 125 cubic feet per minute as known in the industry. Alternatively, portable suction units, including ones having lesser cubic feet per minute flow rates, may be located on the job site as well. Additionally, the present invention may be utilized with higher flow rates and/or multiple conduits attached in parallel to the suction chamber, each with the flow rate (such as 125 cfm) thereby providing even greater suction in water removal.

Device 21 includes a handle arm 31 in the preferred embodiment as shown attached to a control handle 33. The arm and handle may take a variety of configurations and preferably, but not necessarily, include actuation controls for advancing and reversing the drive motor/drive system. Arm 31 is connected to a housing 35 (see FIG. 1A) with a front face 49. Optionally, housing 35 includes receptacles for weights and/or ballast. Ideally, face 49 is vertical or rearwardly inclined with roller 41 located therealong the front to facilitate water removal next to walls. As illustrated, a pair of removable weights 37 and 39 may be lowered into respective weight holders 37*a* and 39*a*. Preferably, the collective weight of these weights is in excess of 50 pounds, in excess of 75 pounds, and preferably is about 100 pounds. They are illustrated with handles to facilitate their removal, making relocation of the overall device 21 easier by breaking it down by weight components. Additionally, the weights are preferably located above, and preferably directed above, the compression element, suction roller 41 in the illustrated FIGS. 1A to 5 embodiment. As illustrated, roller 41 protrudes below a downward facing opening 43 to facilitate simultaneous compression of the carpet and suction of liquid therefrom. Preferably, other wheels or rollers, such as wheel 45 located near the rear of the housing, are provided for operational stability. Such stability preferably includes maintaining suction bar, or frame 53, parallel with the carpet and the floor and level, with the front bar and rear bar thereof maintaining an equivalent seal with the carpet as it slides across the carpet. A drive motor, such as electric motor 47 (see FIG. 1B), provides for motorized advancement and reversal of the device 21. Drive motor 47 is preferably coupled to roller 41 by drive chain or belt 57, shown with a guard, and associated gears or other engagement mechanisms, coupling the gear box from the motor to the roller. For safety, it is preferred that motor 47 is low voltage (e.g. 20 to 90 volts). Alternatively, the drive means may be attached to a separate wheel mechanism, although it is preferred to be attached to the compression roller 41 with the associated weight for engaging traction on the carpet. Optional ballast 51 is provided above and around the suction chamber 55, providing further downward force on the roller. In the preferred embodiment, ballast 51 is steel, stainless steel blocks, or steel shot. A suction chamber 55 being defined and enclosed by suction chamber walls 56 is around roller 41 and coupled to conduit 27. Suction chamber 55, preferably cylindrical, in the FIGS. 1A–5 embodiment is defined in its lower most position by frame 53 which acts as a suction bar. The bar in the preferred embodiment is formed from round bar stock of about half an inch in diameter. As illustrated, its under surface which contacts the carpet is semi-cylindrical, rounded and smooth to facilitate sliding across the carpet. Downward facing opening 43 is ordinarily formed by frame 53 (see FIG. 4). Suction chamber 55 is fluid tight and in fluid tight communication by welding or other connection to the intake end of the conduit 27, thereby allowing water intake at opening 43 and discharge at the point of coupling 29.

Figure 3A:
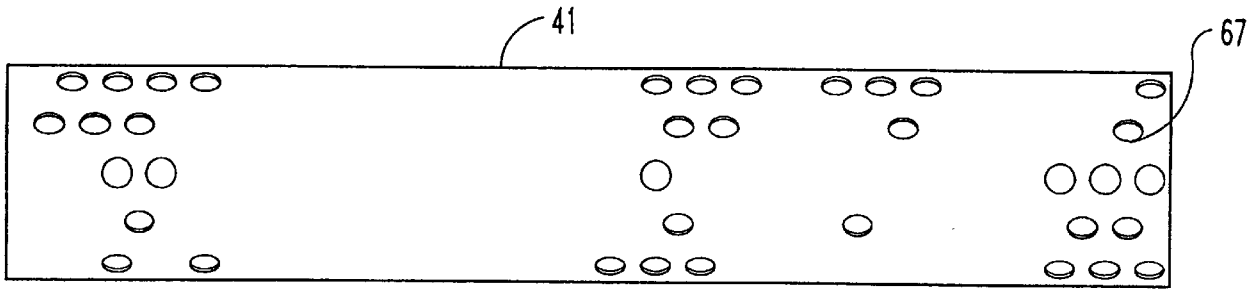
FIG. 3A is a bottom view of the roller taken in isolation.
Figure 5:
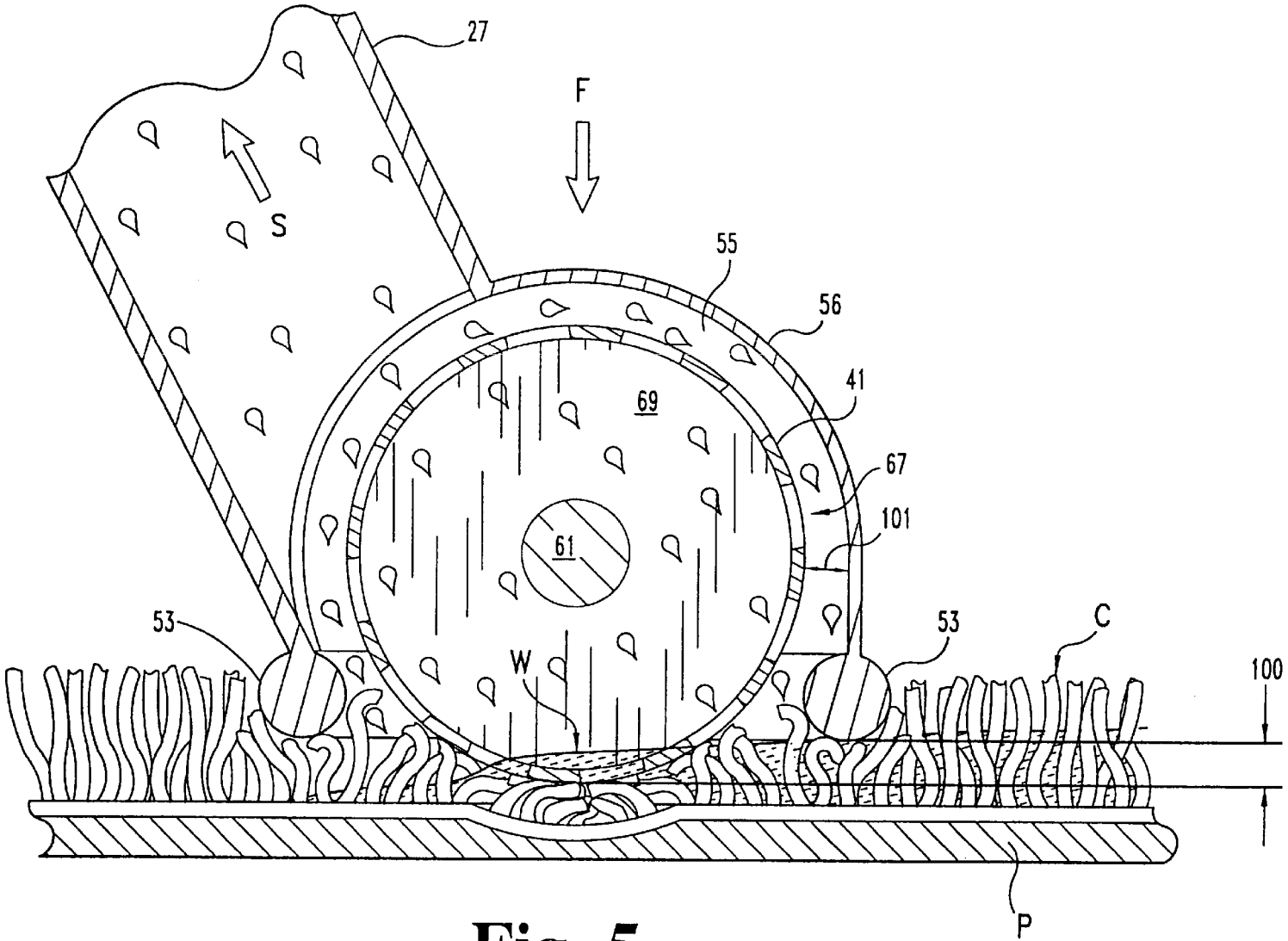
FIG. 5 is a side cutaway view showing a roller and suction chamber in engagement with flooded carpet.

Roller 41 is wider than its diameter and rotates about a horizontal axis rotation, preferably about roller axle 61 which rotates in bearing and support assembly 63 and 65. In the illustrated embodiments, roller 41 has a hollow chamber 69 therein (see FIG. 5) whether or not there is a full longitudinal axle or alternatively, stub axles. In the illustrated embodiments, roller 41 has an outside diameter typically ranging between 1.5 and 6 inches, and preferably approximately 2.65 inches and a width preferably of approximately 14.5 inches and is fabricated from 16 gauge stainless steal having a plurality of holes (typically 0.375 inch diameter) therein and spaced at typical spacings of 0.560 inches laterally and 0.45 inches circumferencially, resulting in a perforation density of about 50%. Naturally, these openings and dimensions may vary in size, shape and spacing. FIG. 3A for illustration purposes only has openings, such as opening 67, shown in parts thereof, it being understood that such openings preferably cover entire surface thereof. The openings contribute to the provision of a rigid anti-wave roller which allows the roller to advance across the flooded carpet, compressing the carpet while allowing water to pass through the openings 67 into the hollow chamber 69 of the roller. In this way, the water is not squeegeed or forced forward in a substantial way. Illustrated in FIG. 5, roller 41 at its lowest location protrudes beneath the bottom of bar 53 by distance 100. While distance 100 may vary, the preferred distance 100 is approximately a quarter of an inch. In this way, water W, which is flooding carpet C above pad P, is allowed to pass underneath the bottom of suction bar 53 and into suction chamber 55. This occurs nevertheless, while roller 41 compresses (via compression force F) the nap of the carpet (see the six o'clock position of roller 41 in FIG. 5). As such, air is sucked under the suction bar 53 and through the carpet nap and pad and water is sucked out by sucking action S as shown as water droplets in FIG. 5. The openings 67 in the roller are believed to enhance performance by providing an anti-wave feature, namely roller 41 does not squeegee a wave of water out in front of it, thereby pushing the water away from suction chamber 55. Preferably, suction chamber 55, and its defining opening with frame 53, surround the front and back and sides of compression device 41, although it is believed that alternative arrangements including a front and/or back flume, while not preferred, would provide satisfactory results. It is believed that it is preferable to have a reasonably close spacing between the roller and the suction chamber and suction bar so as to concentrate to keep suction flow rate in a narrow area to maintain suction and velocity with such arrangement, including a suction gap along the leading edge. A solid roller is believed to produce satisfactory (although not ideal) results around bar 53 when suction bar is arranged as described and maintained level to form an elevated seal and is surrounded by suction on the front and back. In the preferred embodiment, a distance shown as 101 (see FIG. 5) is believed to be best at about one quarter of an inch, although it is believed that other reasonably narrow distances would work as well. Indeed, the interior distance in the preferred embodiment between the long spans of suction bar 53 are the same as the outer diameter of roller 41. Thus, as illustrated in FIG. 5, the tangential spacing between the outer surface of roller 41 and frame 53 is typically less than or equal one quarter of an inch. Such spacing can vary to half an inch, and believed to vary outwards of one to two inches depending on variables such as the amount of water removal desired and suction flow rated applied.

Figure 3B:
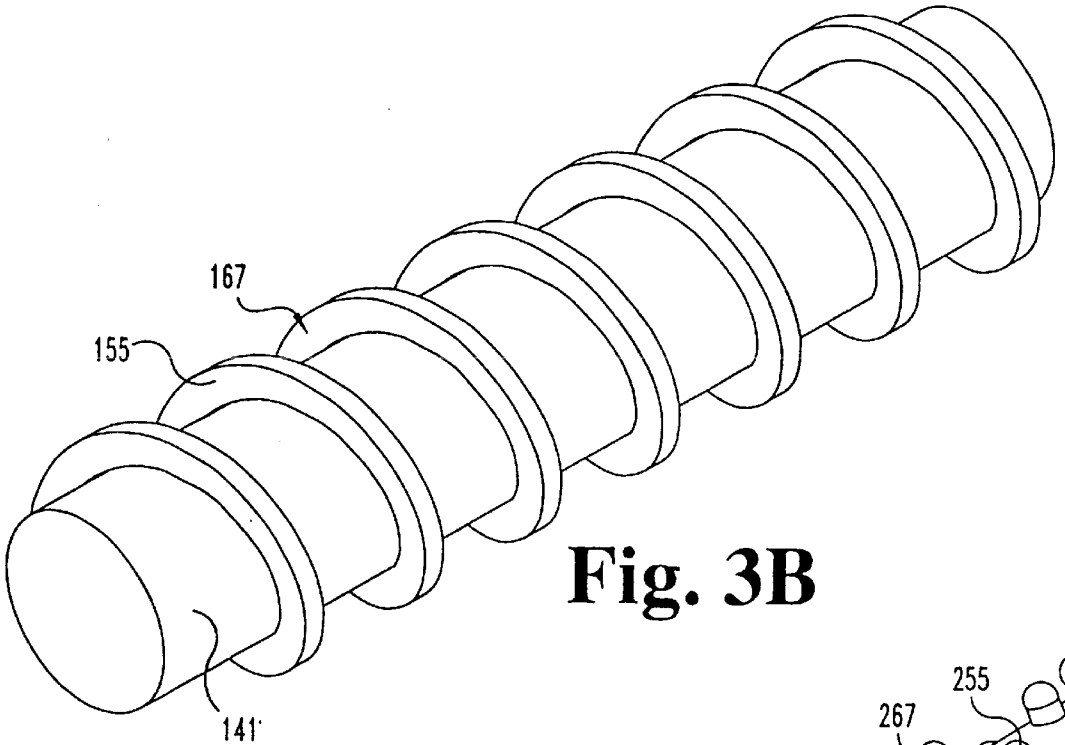
FIG. 3B is a perspective view of an alternative roller embodiment taken in isolation.
Figure 3C:
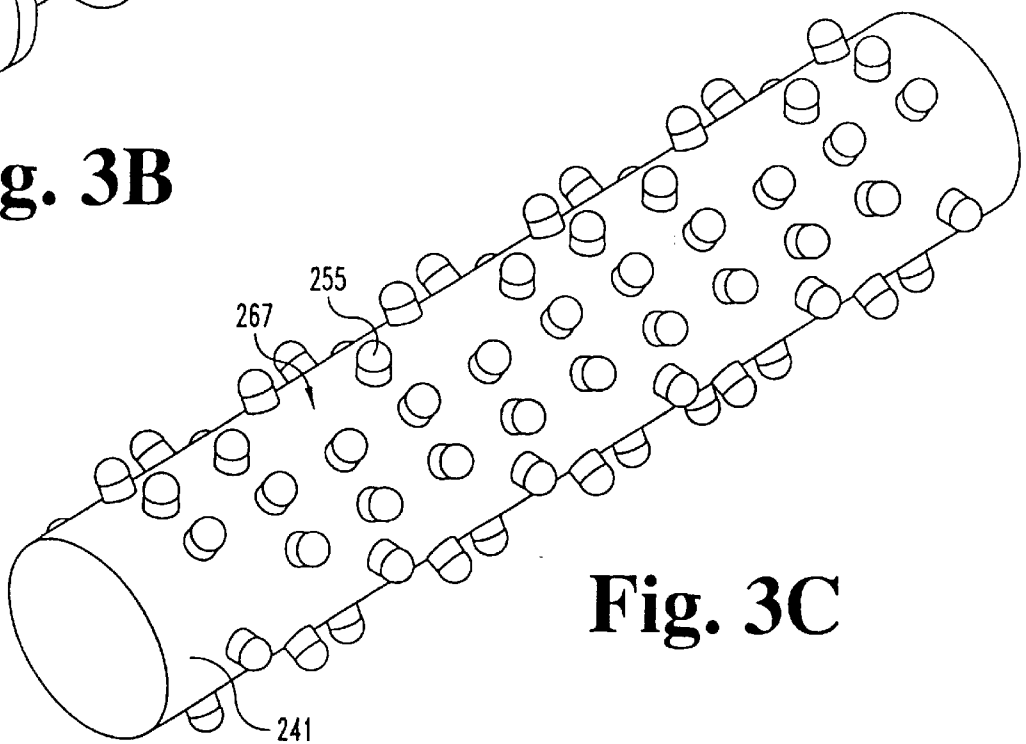
FIG. 3C is a perspective view of another alternative roller embodiment taken in isolation.

The provision of openings 67 in roller 41 also provide the additional benefit of traction as the roller is advanced along the carpet by the drive system. The self-propelled aspect of the invention is advantageous, with roller RPM of 1 to 60, and preferably about 14 to 35 RPM, working well for water removal. Alternative embodiments of the anti-wave roller concept are disclosed in the rigid rollers shown in FIGS. 3B and 3C. In the version of FIG. 3B the roller 141 has rigid protrusion 155. As shown therein, such protrusion 155 is configured like a helical worm gear and is rigid so as to allow the weights to exert downward compressive force on the carpet nap through protrusion 155 while allowing interstitial chamber 167 to reside therebetween so as to prevent the roller from acting as a wave-creating squeegee. Variations on the same include varying worm gear pitches as well as interstitial breaking of the helical worm gear portion 155. FIG. 3C discloses another anti-wave roller 241 including a plurality of rigid protuberances 255 with water chamber 267 being defined by the interstitial spaces therebetween. The number, shape and arrangement of such protuberances 255 can be increased and modified according to design to allow the roller to advance across the carpet and compress the carpet nap without pushing the water out in front of the suction take-up. Using alternative embodiments are contemplated with the protuberance 155 and 255 projecting beneath opening 43 defined in the suction chamber, preferably a distance about equal to or greater than distance 100. Such protuberances also provide the carpet traction function with the carpet nap. Anti-wave carpet compression may also be achieved by a series of parallel banana-shaped bars at the bottom of opening 43 which act as skids along the bottom of the opening, imparting the downward compressive force on the carpet nap without creating a water wave in front of the suction chamber. Variations on these geometries may be included, such as a roller comprising a cylindrical cage structure, it being preferable that the components be made of stainless or other rigid material for durability and compressive attributes on the carpet nap.

Alternatives to the weighting system discussed above include replacing weights 37 and 39 with an operator seat mounted to the unit or having the operator stand in the weight holders or on weights in the weight holders, so as to exert force above, and preferably directly above, roller 41. Alternatively, the weights may be replaced with a hollow water chamber. Such chamber may be fillable and/or may be in line with the suction conduit path (at least temporarily) to allow priming and filling by the operator initially with the water on the job site, thereby mitigating the weight of the unit when empty for transportation purposes.

Referring now to FIGS. 6A through 9, an embodiment of the invention with an on-board vacuum generator is shown. In this embodiment, some of the components can be (are not necessarily) exactly the same as in the previously described embodiment and, therefore, are given the same reference numerals. Some other components are usually at least slightly different from some in the previously described embodiment, so are given different reference numerals.

In this embodiment, housing 71 is similar to that in the previous embodiment and has a suction chamber 72 at one end surrounded by frame 53 fixed and sealed to the downwardly opening end of the suction chamber. Roller 41 projects slightly below the lowermost surface of the frame 53. The housing has one end wall 73, a bottom wall or floor 74 which turns upward at 75 to portion 74U and then downward at 76 forming a downwardly opening notch to which a sleeve 77 is secured for receiving and mounting the axles for wheels 45. An opening or openings are provided in the top of the housing between the end wall 73 and intermediate wall 78 and through which ballast in the form of shot or fixed weights may be mounted, if desired, in a manner similar to that shown in FIG. 1B. However, behind the downturned flange 78, a panel 79 extends downward enclosing the end of the housing opposite that enclosed by wall 73. A cover 80 having a downturned flange 81 adjacent side walls and end wall 73 of the housing, provides a lid for the housing and has an upturned sloped wall 82. This lid provides a comfortable place for the operator to stand on the housing to provide a downward load on the roller 41 for pressing it against the carpet in a manner as described with reference to the previously described embodiment.

A pair of brackets 83 is secured to the upturned portion 74U of the bottom wall 74. A steering handle mounting bracket 84 is bolted to brackets 83 by bolts in one or more of the holes 86 and has a tube 87 affixed to it. A handle arm 88 is rotatably received in the tube 87 and is provided with a yoke 89 under the lower end of the tube, with a thrust bearing 90 between the top of the yoke and the bottom of the sleeve. A wheel 91 is rotatably received in the yoke 89 and normally is engaged into the carpet at a supporting level such as 92 at which the roller 41 and this steerable wheel 91 are supported by the carpet. A control handle assembly 93 mounted near the upper end of the handle arm 88 has a pair of hand grips 94 whereby the operator standing on lid 81 can steer the device as it is driven along the carpet by the roller 41 driven by the traction motor 47.

In this embodiment, an on-board vacuum source 96 is provided. It is mounted to the housing 71 and includes a vacuum tank 97 and vacuum generators 98. In the illustrated embodiment, the vacuum generators 98 include blowers 98B driven by electric motors 98M and having intake pipe-stubs 98S received through receiver holes in the top 97T of the tank and sealed to the tank top by gaskets (not shown). The blowers exhaust through ports 98E inside the cover 100, from which the air can escape through the louvers on the four sides, particularly at 101 in the direct path of the discharge ports 98E. The vacuum generators are fastened to the top of a pan 102 having an upturned perimetrical flange which receives and captures the lower edge of the cover 100. The cover has a set of operating switches 103 on its top and which are protected by a plate 104 spanning the space between a pair of handles 105 which can be used to conveniently lift the cover out of the pan 102 for access to the vacuum generators. The vacuum generators can be readily separated from the vacuum tank by simply lifting the pan 102 from the top 97T of the tank, during which the generator intake stubs 98S are pulled out of the receiver holes in the top 97T of the tank, leaving the two receiver holes open.

Figure 8:
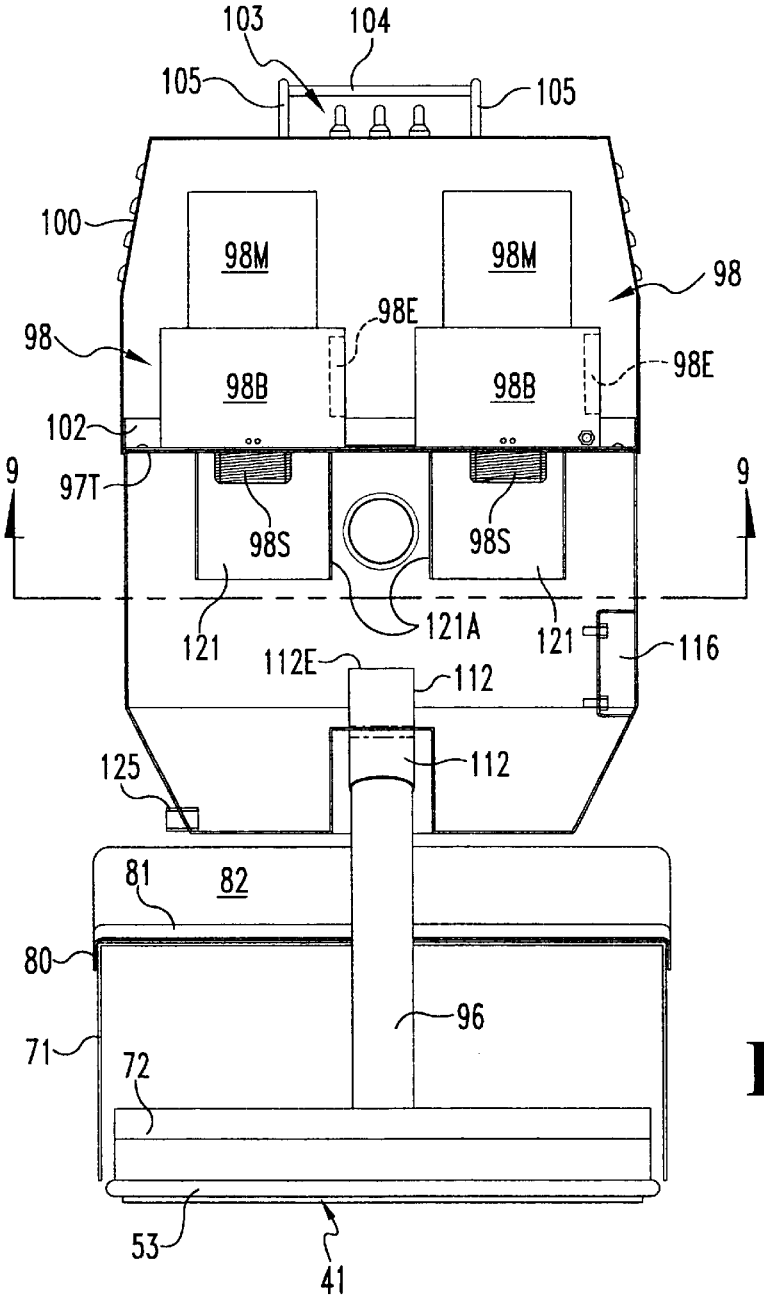
FIG. 8 is a sectional view taken at line 8—8 in FIG. 6B and viewed in the direction of the arrows.

A recess 110 is provided at the bottom of the tank and has an intake port 111 in the top of the recess receiving an intake tube 112 receiving the discharge end of conduit 96 therein. The intake end of conduit 96 is sealed to the suction chamber 72. As shown, the conduit 96 is relatively short in length from its intake end to its discharge end, being less than the distance between the axis of roller 41 and axis of wheels 45, and typically less than 14 inches. Also, the elbow 112 is relatively straight, the angle between the vertical portion of the elbow and the inclined portion thereof being less than 25 degrees. With the straight, short conduit 96, and relatively straight elbow, there is minimal resistance to liquid and air flow along a path from the suction chamber 72 to the vacuum tank 97. The total of all angles of departure of the path from a line between the center of the conduit intake end and the center of the elbow discharge end 112E, is less than 30 degrees. The horizontal distance between a vertical line from the center of tank inlet port 111 and the center of the intake end of conduit 96 is minimal and, as shown in FIG. 8, they are in the same vertical plane normal to the axis of the roller. As a consequence, the head loss between the intake end of conduit 96 and the discharge end 112E of the elbow 112 into the vacuum tank is minimal. Even if the conduit 96 were curved, the close vertical proximity of the tank inlet to the suction chamber 72, and the close proximity of a vertical projection of the tank inlet measured in a horizontal direction to the conduit inlet, still minimizes the total angular departure of the path from a straight line between the conduit intake end and the tank inlet port. This is true even if the path were in a slightly serpentine configuration between those points as might be the case if the conduit is a flexible hose.

Figure 6A:
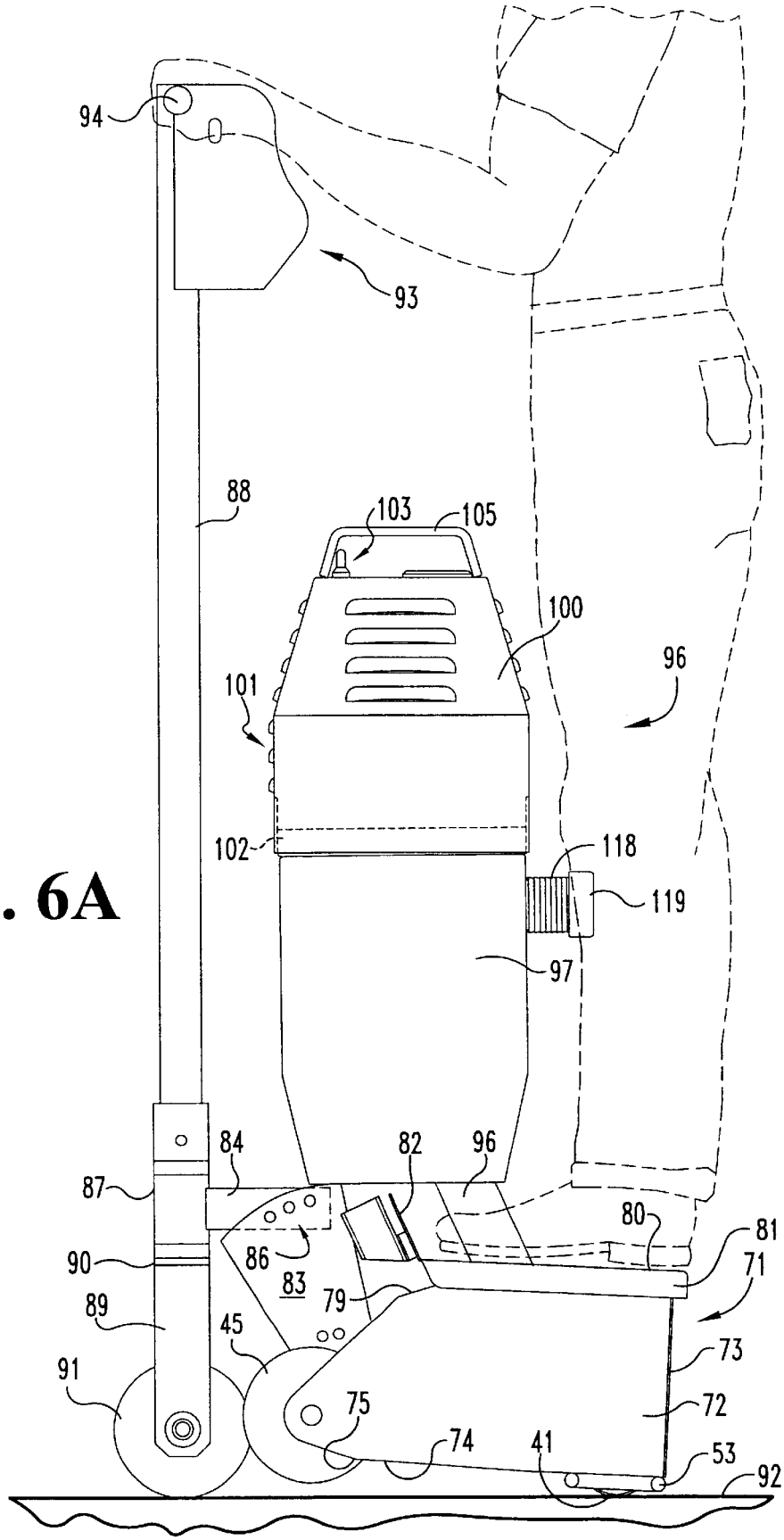
FIG. 6A is a side view of an alternate embodiment with an on-board vacuum source.
Figure 6B:
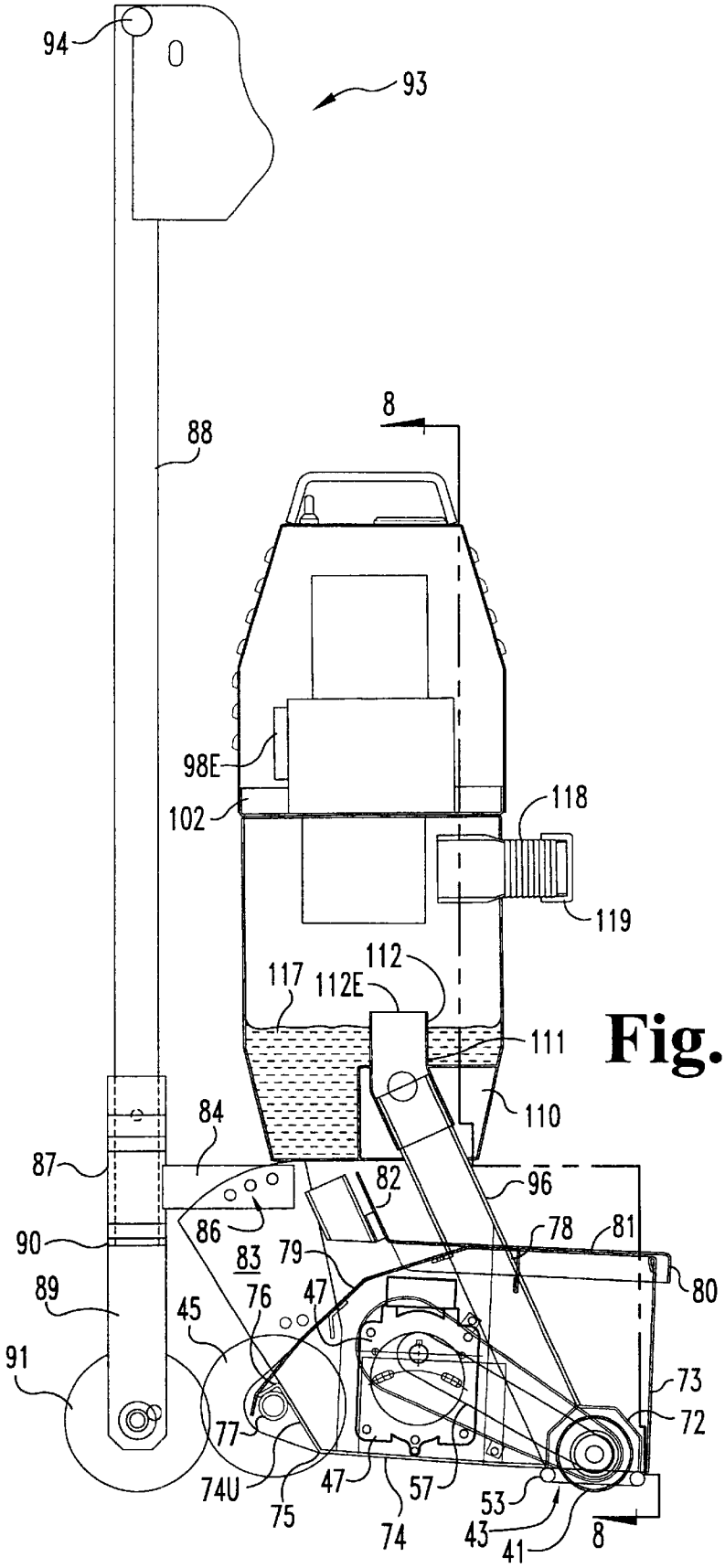
FIG. 6B is a partially cutaway side view of the FIG. 6A embodiment.
Figure 7:
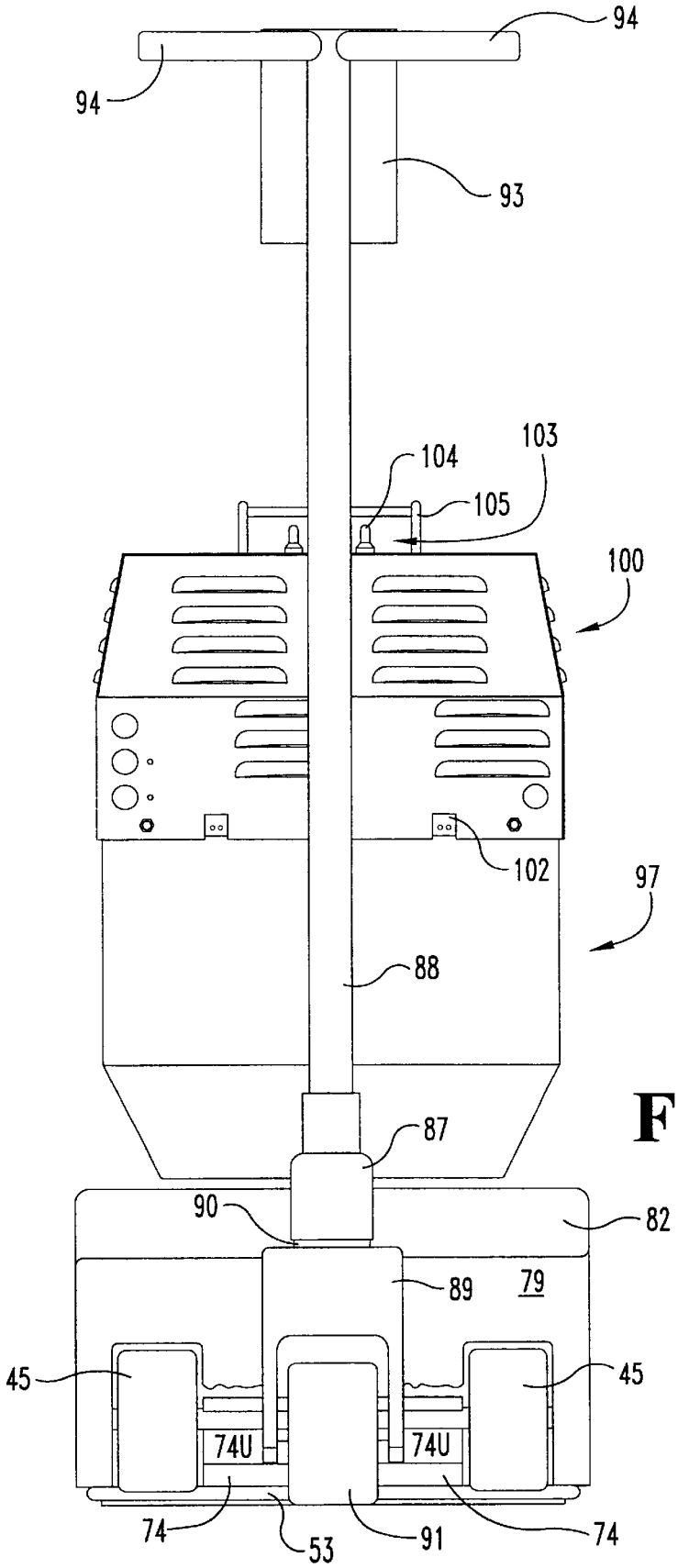
FIG. 7 is a left end view of the FIG. 6 embodiment.

Since the tank is intended to accumulate water removed from a carpet, the upper edge 112E of the discharge portion of the elbow 112 is relatively high in the tank. To prevent excessive accumulation of water, and overflow back down the conduit 96 upon turning off the motor/s 98M, a high-level limit switch assembly is mounted in the recess 116 in the tank to shut off the vacuum generators when the water accumulated reaches a level 117 such as shown in FIG. 6B. A valved drain 125 is provided at the bottom of the tank.

An accessory port and stub 118 are provided in the wall of the tank for connection to a vacuum wand hose when desired. Meanwhile, that stub is capped by a cap 119, as shown.

Figure 9:
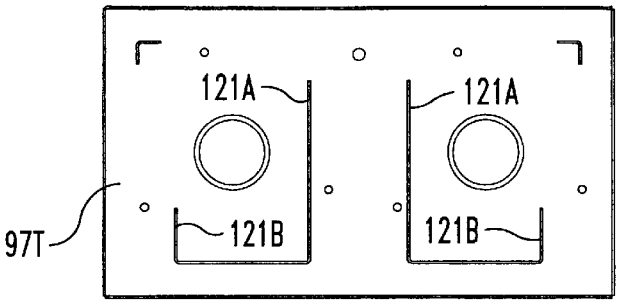
FIG. 9 is a sectional view taken at line 9—9 in FIG. 8 and viewed in the direction of the arrows.

Referring to FIG. 9 and the others, and in order to impede passage of water from the discharge end 112E of the elbow 112, through the intake pipe stubs 98S to the intakes of the blowers 98B, baffles 121 are provided in the tank. They project downward from the underside of the tank top 97T and have walls 121A facing the space between them and the path of discharge from the elbow 112, and short walls 121B facing the side walls of the tank.

In the operation of this embodiment of the invention, the operator adjusts the height of the wheel 91 relative to the bottom 74 of the housing by selection of one of the three possible relationships of the bracket 84, relative to bracket 83. In those applications where steering of the device in a circular path of short radius is needed, it is desirable that the wheel 91 be adjusted low enough relative to the floor 74 to avoid interference of the wheels 45 with steering of the device. In any case, however, compression of the carpet by roller 41 and the sealing feature of the vacuum entrance frame 53 in the carpet, is not disturbed.

After the wheel height is adjusted, and with the cap 119 installed on the suction stub 118, the operator steps onto the lid 80, turns on the vacuum generator motor or motors, depending upon the amount of vacuum desired. Then the operator grips the handle bars 94, and with switches on control panel 93, selects motor direction and speed, turns on the traction motor 47 and begins travel of the device across the carpet in whichever direction is desired. Since the drive from the motor to the roller may be by a chain, or gear belt or other powered connection, it is preferable that the motor be reversible and operable at a selectable speed, with appropriate switches in panel 93 to accomplish this. Various arrangements can be used including, but not limited to, a direct current motor energized by an on-board battery or from an alternating current supply with transformer, rectifier and voltage controller so the device can be operated in either a forward or backward direction at variable speed and steered while so-moving. When the amount of water removed from the carpet has accumulated in the tank sump to a level operating the float or other sensing switch at 116, it will interrupt the power to the vacuum motor/s 98M. Then the sump can be drained by opening the valve on the drain port 125.

If it is desired to use a pickup wand with the device, the cap 119 can be removed and a hose or other attachment of the wand to the intake stub 118 can be made. A suitable sponge or other seal can be placed at the suction chamber intake 43 to close the entrance inside the frame 53 so that the entire suction from the suction generators can be applied to the wand. Alternatively, however, and since the available suction (particularly with both generators 98 turned on) is so significant, in many instances it will not be necessary to do anything to prevent flow through conduit 96, as more than enough vacuum is available at 118 to handle most wand suction needs.

After use of the device and when the tank has been drained, the operator can walk on the floor and, if desired, turn the handle arm around 180 degrees and walk the machine to a storage location or to a service truck for transfer to another site for rendering a deflooding service. To facilitate transport in a vehicle, if space requirements are critical, the steering assembly can be removed from the bracket 83 and the tank also can be removed. Also, if desired, the vacuum generator assembly can be removed from the tank as a unit. Further, if desired, the cover 100 can be secured to the upstanding flange of pan 102 by bolts or screws so that the vacuum generator unit can be lifted as a unit by gripping the handles 105. Suitable electrical interconnects can be provided in the top of the tank and the bottom of the pan to facilitate removal of the pan from the tank without dangling wires. Similar provisions can be made between the switch assembly 103 and the motors 98M, although it is likely that some wiring will be used in most instances in that case. Similarly appropriate plugs and cables are provided from the control unit 93 to the traction motor assembly 47.

If desired for quick change of roller types, appropriate slots in the ends of the vacuum chamber 72 can be provided so that any of the three styles of rollers shown in FIGS. 3A, 3B and 3C or any other desired style can be used. Also, although the rollers may typically have an exterior surface of stainless steel, other materials may also be used, particularly if it is desired to drive the device across flood areas which include carpeted areas either framing or framed by hard surface flooring which is not to be damaged by the roller.

As is true with the previously described embodiment, this embodiment of the invention can be used not only with an on-site vacuum source, but also with a remote vacuum source. A vacuum service truck located outside the flooded area is an example that was given above for the first embodiment. With the vacuum tank of the present embodiment in place, an adjacent or remote vacuum source coupled to stub 118 can be used. With the vacuum tank removed, a vacuum hose from an adjacent, or from a remote suction source such as a service truck, can be easily connected to the discharge end of conduit 96 of the present embodiment to provide the needed vacuum. The device may then be operated in the same manner as described above, using the controls on panel 93. If desired, an operator's seat can be installed, preferably located so that the operator's weight is used for optimal compression of the carpet at the roller. Also, if desired, the traction motor can be coupled to wheels 45 in addition to, or instead of the roller 41, or a separate traction motor may be mounted on or coupled to yoke 89 to drive the steerable wheel.

While the invention has been illustrated and described in detail in the drawings and foregoing description, the same is to be considered as illustrative and not restrictive in character, it being understood that only the preferred embodiment have been shown and described and that all changes and modifications that come within the spirit of the invention are desired to be protected.

What is claimed is:

1. A device for deflooding liquid from carpet, comprising:

a housing;

a suction conduit with a discharge end and an intake end, said discharge end being couplable with a suction source for suction of the liquid through said conduit;

an enclosed suction chamber at said housing and coupled to said intake end of said suction conduit, said suction chamber having a downward facing opening;

a roller located within said housing and rotatable around a horizontal axis of rotation, said roller partially protruding below the level of the bottom of said downward facing opening, with said horizontal axis of rotation positioned at a level above the first-mentioned level and, wherein said roller compresses the carpet with substantial downward force to press liquid from the carpet; and a drive motor coupled to said roller to drive the roller across the carpet.

2. The device of claim 1 wherein said housing has a portion arranged to receive at least 75 pounds of weight located above said roller for applying compressing weight to the carpet through said roller.

3. The device of claim 2 wherein one or more weights are readily removable from the device by the operator.

4. The device of claim 1 wherein said suction source is in a service truck remotely located from the device and has an air flow rate at or exceeding approximately 125 cubic feet per minute.

5. The device of claim 1 and wherein said suction chamber is coupled to said intake end of said suction conduit inside said housing.

6. The device of claim 1 and wherein said roller is a wide roller.

7. The device of claim 1 and wherein said roller is in said suction chamber.

8. The device of claim 1 and wherein said discharge end is couplable with a remote suction source in a service vehicle remotely located from the device.

9. The device of claim 1 and wherein the suction chamber is at one end of said housing, the device further comprising:

steering means at the other end of said housing and operable to steer the device across the carpet.

10. The device of claim 9 and wherein the steering means includes:

a steerable wheel engaging the carpet;

a steering shaft coupled to the wheel; and a shaft operating member for actuation by the device operator to the steer the device.

11. The device of claim 1 and wherein:

said suction source is on-board and supported at a level above the level of the bottom of said downward facing opening; and said conduit is straight from its intake end at said suction chamber to its discharge end coupled to said suction source.

12. The device of claim 1 and wherein said suction source is on-board and includes:

a motorized vacuum generator with an intake;

a vacuum tank communicating with said generator intake and having a suction port; and wherein the discharge end of said conduit is coupled to said suction port.

13. The device of claim 12 and wherein:

said vacuum tank has a second suction port adapted to connection to a vacuum cleaning wand.

14. The device of claim 12 and wherein:

the length of said conduit from said intake end to said suction port of said tank is less than 14 inches.

15. The device of claim 12 and wherein:

said conduit, and the coupling of said intake end to said suction chamber, and the coupling of said discharge end to said suction port of said vacuum tank, are arranged to establish a fluid flow path between said suction chamber and said vacuum tank having a total of any changes of direction of the path along the path from a central axis of said intake end to a central axis of the suction port, of less than 30 degrees.

16. The device of claim 12 and wherein:

said conduit, and the coupling of said intake end to said suction chamber, and the coupling of said discharge end to said suction port of said vacuum tank, are arranged to establish a fluid flow path between said suction chamber and said vacuum tank having a low vacuum head loss from said vacuum tank to said suction chamber.

17. The device of claim 12 and wherein:

said vacuum tank has a removable lid sealed to the tank; and said motorized vacuum generator is mounted to the lid, with said intake communicating with the interior of the tank to establish a vacuum in the tank.

18. The device of claim 17 and wherein:

a second motorized vacuum generator is mounted to the lid and has an intake communicating with the interior of the tank;

the tank has a sump portion;

the tank has baffles therein around said intakes and projecting toward the suction port of the tank and toward the sump portion to impede passage of liquid from the suction port to said intakes and promote passage of liquid to said sump portion.

19. The device of claim 12 and wherein:

said housing has a portion above said roller and adjacent said tank and arranged to receive weight thereon for compressing the roller against the carpet.

20. The device of claim 19 and wherein said weight receiver portion is arranged to receive and support the feet of the operator.

* * * * *